United States Patent [19]

Duchenne

[11] 3,971,433

[45] July 27, 1976

[54] APPARATUS FOR MOLDING CAST IRON PARTS CONTAINING SPHEROIDAL GRAPHITE

[75] Inventor: Henri Duchenne, Vanves, France

[73] Assignee: Regie Nationale des Usines Renault, Boulogne-Billancourt, France

[22] Filed: Mar. 14, 1974

[21] Appl. No.: 451,196

[30] Foreign Application Priority Data

Apr. 20, 1973 France ..... 73.14539

[52] U.S. Cl. ..... 164/362; 164/55; 164/349; 164/363

[51] Int. Cl.[2] ..... B22D 27/20; B22C 9/08; B22D 1/00

[58] Field of Search ..... 164/55, 56, 57, 58, 164/59, 349, 358, 359, 360, 362, 363

[56] References Cited

UNITED STATES PATENTS

| | | | |
|---|---|---|---|
| 1,664,452 | 4/1928 | Daniels et al. | 164/358 |
| 3,658,115 | 4/1972 | Ryntz et al. | 164/57 |
| 3,746,078 | 7/1973 | Moore et al. | 164/55 X |

*Primary Examiner*—Ronald J. Shore
*Assistant Examiner*—Gus T. Hampilos
*Attorney, Agent, or Firm*—Oblon, Fisher, Spivak, McClelland & Maier

[57] ABSTRACT

Apparatus for molding, by inoculation, cast iron parts requiring a spheroidal graphite texture, includes a mold containing the impression of the item to be cast and a treatment chamber, situated within the inlet channel of the mold, which opens into the impression of the part. The chamber contains the necessary inoculant for the casting of parts, and the volume of the chamber is equal to the sum of the volumes of the part being cast and the deadhead. The chamber is closed off from the impression portion of the mold by means of a temporary plug which is capable of being destroyed by means of the combined action of the temperature and pressure of the molten metal, the inoculation being performed within this chamber during the time necessary for the destruction of the temporary plug. Further, a separator disk of neutral refractory material, having a cavity containing a substance for completing the action of the inoculant, is placed immediately downstream of the temporary destructible plug within the inlet to the impression portion of the mold. The apparatus is particularly adapted for the production of rather large cast iron parts with spheroidal graphite, such as for example, the crankshafts of internal combustion engines.

3 Claims, 4 Drawing Figures

APPARATUS FOR MOLDING CAST IRON PARTS CONTAINING SPHEROIDAL GRAPHITE

BACKGROUND OF THE INVENTION

1. Field of the Invention

The present invention relates generally to apparatus for molding by inoculation of cast iron parts requiring a spheridal graphite texture, and more particularly to apparatus for molding or casting rather large parts, such as for example, the crankshafts of internal combustion engines.

2. Description of the Prior Art

Inoculation of molten iron for the purpose of improving the texture of the cast components, with the aid of additional alloys, such as for example, silicon and magnesium and various metals, and especially for obtaining a spheroidal graphite texture, is of course known. It is also a known fact that the effect of the inoculation decreases rapidly with time whereby it is most desirable to perform such process immediately before the solidification of the metal so treated if a homogeneous structure is to be obtained.

Many inoculation techniques and apparatus for carrying out the same have been employed for this purpose, such as for example, one such technique wherein the finely divided inoculant has been introduced into the melt prior to pouring, the inoculant and melt being mixed together within the ladle. Another technique of double inoculation has also been utilized, the melt being initially inoculated within the ladle prior to the commencement of the pouring operation and the inoculation being subsequently repeated immediately prior to pouring either, for example, during the course of transferring the composition within small hand ladles, or by passage through funnel-configured filters containing a suitable quantity of the inoculant. An attempt has also been made to inoculate the molten metal by a continuous process or repeated, directly applied dispersions within the gate, or by means of the introduction of powdered inoculent into the mold.

These techniques however, have not been proven sufficiently reliable with respect to the homogeneity of the texture of the castings, and consequently apparatus was conceived whereby the molten iron would be placed in contact with the inoculant while the same was flowing within the system of channels or runners of the mold, the inoculant coating or forming a body fixedly held within the mold and preferably being in the form of a perforated mold core which would be able to be progressively dissolved by means of the molten metal pouring in around it.

Within a more sophisticated version of the preceding apparatus, the fragmented inoculant would be placed within the runners of the mold immediately upstream of an arrangement, such as for example, a grill of refractory material or a perforated mold core which thereby permits passage therethrough of the molten metal and dissolved inoculant while intercepting and retaining undissolved inoculant particles.

Within these apparatus facilitating progressive dissolution of the inoculant particles by means of the poured metal, it is necessary however that the dimensions of the particles, when the pouring operation is finished, be greater than those of the openings within the grill so as to allow only the passage therethrough of the molten metal and dissolved inoculant. As a result, greater quantities of inoculant than required for achieving a particular texture, must be used and the residual inoculant embedded within the deadhead subsequent to solidification is lost. In addition, if undissolved particles of inoculant, having dimensions smaller than that of the grill, pass therethrough, the texture of the resulting composition will obviously be deleteriously affected.

Furthermore, during the time between the start and finish of the pouring operation, there is great variation within the exchange surface between the molten metal and the inoculant, causing in particular a decrease in the degree of inoculation. If this is not too objectionable for the casting of small pieces, such is to the contrary for rather massive parts, such as for example, the crankshafts of internal combustion engines which require a rather long time for the pouring operation, there thus being a great risk of insufficient homogeneity within the texture thereof.

SUMMARY OF THE INVENTION

Accordingly, the principal object of the present invention is to provide an improved apparatus which will remedy the afore-noted difficulties.

The foregoing and other objects are accomplished according to the present invention through the provision of apparatus which includes a mold having the impression of the part to be cast, and a treatment chamber disposed within the pouring channel of the mold and containing the inoculant necessary for the casting of such parts. The volume of the treatment chamber, opening into the impression portion of the mold, is equal to the sum of the volumes of the part being cast and the deadhead of the part, and the chamber is closed off from the impression portion of the mold by means of a temporary plug comprising a sheet metal plate which is destructible by means of the combined action of the temperature and pressure of the molten metal, the inoculation being effected within the chamber during the time necessary for the destruction of the plug, the inoculant thereby being uniformly distributed within the mass of the molten metal prior to the metal filling the mold.

The apparatus of the present invention further includes the interposition of a trap, between the gate and the runner of the treatment chamber so that even in case of momentary, accidental interruption of pouring, the molten metal disposed within the chamber is sealed off from the ambient atmosphere whereby oxide films harmful to the quality of the part do not form.

In conjunction with the destructible plug, the invention further includes the use of a separator disk, made of neutral refractory material, having a cavity containing an active substance and placed immediately downstream of the temporary destructible plug within the inlet runner to the impression portion of the mold, the substance being retained within the cavity by means of the temporary plug upon one side and by means such as for example, a layer of paper firmly stuck to the bottom of the disk cavity upon the other side. The active substance can be, for example, a post-inoculation deoxidizer intended to complete the action of the inoculant contained within the treatment chamber as well as to reduce the oxides formed as a result of the melting of the plug when this component is metallic. In addition to its role of delimitation between the casting and the deadhead, the disk facilitates the uniform distribution of the treating substance within the mass of molten metal during its entrainment by the latter.

The simultaneity of the dissolution of the various inoculant particles throughout the mass of molten metal within the treatment chamber of the present apparatus thus exhibits certain advantages over the known method of, for example, progressive dissolution by eroding away the fragments of inoculant by means of the poured metal. The present apparatus and technique thus permits the realization of a perfect homogeneity of the structure when casting rather massive parts as well as of an economy in inoculant because only the amount of inoculant required for the casting process need be placed within the chamber.

Such apparatus also permits a rapid pouring operation to be conducted, rendering such independent of the human factor, due to the fact that the progressive passage of the mass of molten metal over the inoculant is no longer necessary. Finally, it is extremely easy to control the time of inoculation by suitably selecting the thickness and composition of the temporary plug as a function of the type of inoculant used, the latter of which can be employed in the form of either powder or chips, the powdered form being preferable.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF A PREFERRED EMBODIMENT

Figure 1:
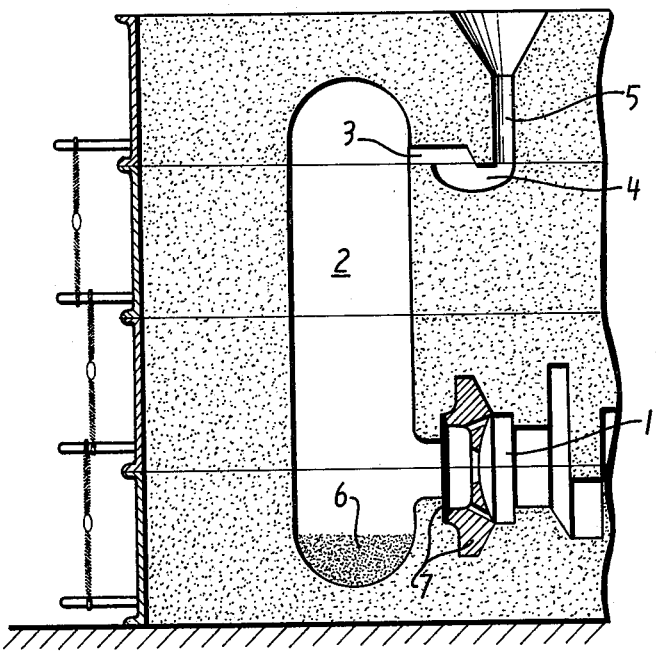
FIG. 1 is a schematic, elevation view of a mold for casting, constructed in accordance with the present invention and showing its cooperative parts.

Referring now to the drawings and more particularly to FIG. 1 thereof, the mold shown in the Figure is a standard foundry type mold, made for example, of molding sand and within which is formed the impression 1 of the part to be cast as well as a treatment chamber 2 which comprises, in order to facilitate control of its volume, a vertically disposed cylindrical portion having hemispherical portions associated with each end thereof. The chamber 2 is so arranged as to extend vertically for a substantial distance above the impression 1 so as to create a pressure column, and its volume is equal to the sum of the volumes of the part to be cast and the deadhead.

Figure 2:
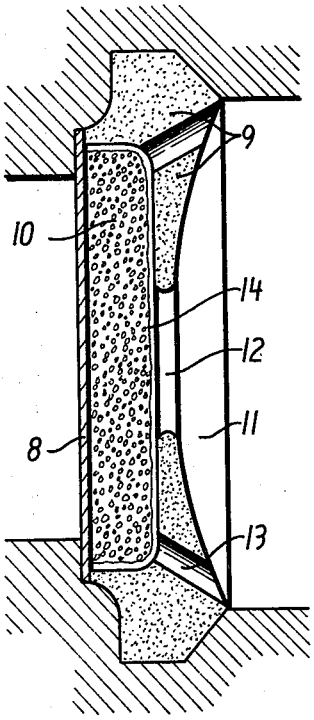
FIG. 2 is detailed, enlarged view of a section of the apparatus of FIG. 1, showing in particular the temporary plug and separation means utilized therein.

Chamber 2 is fluidically connected with and is fed by means of a radially disposed runner 3 located at the base of the upper hemispherical portion and a trap 4 disposed within one of the joint planes of the mold is interposed between the runner 3 and the gate 5 for the purpose of preventing the formation of oxide films upon the metal within the chamber 2 should pouring be temporarily interrupted. The inoculant 6 is disposed within the lower hemispherical portion of chamber 2, and a temporary plug and separator 7, illustrated in detail in FIG. 2, is disposed within the channel interposed between and connecting chamber 2 and the impression 1 of the part to be molded, such also forming the base of the deadhead and being disposed within the joint plane of the casting just above the lower hemisphere of chamber 2.

The temporary plug and separator 7 is seen to include a circular, sheet-iron blocking plate 8 located upon the side of the plug which faces toward chamber 2, and an annular separator disk 9 made of for example, neutral refractory material, located upon the side of member 7 which faces toward the impression 1 of the part to be cast. The blocking plate 8 is secured to the disk 9 at the peripheral portion thereof and the assembly thus formed is embedded at its periphery within the sand comprising the mold. The thickness and composition of the blocking plate 8 which is intended, as noted hereinbefore, to be destroyed by the combined action of the temperature and pressure of the mass of molten metal contained within chamber 2, thus determines how long the plate lasts and therefore the time period for inoculating the mass of molten metal before the same fills the impression 1 of the mold.

The disk 9 has a cylindrical cavity 10 provided within one end thereof so that the opening thereof faces toward chamber 2 while a shallow concave spherical cavity 11 is similarly provided within the other end thereof such that it faces toward the impression 1 of the casting so as to define the end portion thereof upon the runner side of the mold. A central orifice 12 forms the runner which serves to provide communication between the cavities 10 and 11, and a set of channels 13, equidistantly spaced about and near the periphery of the disk 9 are likewise provided for fluidically connecting cavities 10 and 11. A powdered post-inoculant and deoxidizer for completing the action of the inoculant 6 within chamber 2, as well as for reducing the amount of oxides formed as a result of the melting of the blocking plate 8, is retained within the cavity 10 by means of the blocking plate 8 upon one side, and by means of a heavy, thick sheet of paper 14 lining the bottom of cavity 10 upon the other side. The angle of inclination of the channels 13, provided for permitting the escape of the substance contained within cavity 10, is selected so as to assure effective post-inoculation of the mass of molten metal flowing through the central orifice 12.

The operation of the apparatus constructed according to the present invention will now be described. The required amount of inoculant 6 within chamber 2, as well as the temporary plug and separator 7, is placed within the mold assembly. When the molten metal is poured into the mold it is held back by means of the blocking plate 8 so as to fill chamber 2 and dissolve the inoculant 6 without contact with the aatmosphere due to the presence of the trap 4. During the time, the combined action of the temperature and pressure of the mass of molten metal with chamber 2 causes the blocking plate 8 to dissolve or melt, whereby the mass of metal suitably inoculated is then able to pentrate, under the influence of gravity, into the impression 1 of the mold portion, during passage of which, the same reacts with the post-inoculant contained within the cavity 10 of disk 9.

After solidification, the quantity of metal remaining within chamber 2 constitutes the deadhead and contains all of the slag from the reaction, which floats upon the surface due to the density differential thus avoiding the danger of producing inclusions within and harmful to the mechanical properties of the casting. After stripping the casting from the mold, all that remains to be done is to separate the casting from the deadhead at the location of the orifice 12 of the filter 9, the presence of which facilitates such detachment by means of an applied blow or force.

By way of representative examples, there is given below the data and results of two experimental runs, utilizing the apparatus of the present invention, for casting crankshafts for internal combustion engines having a gross weight of 13.5 Kg, the comparison of which demonstrates the ease of control characteristic of the present invention.

EXAMPLE 1

The metal used was a cast iron of a type used for crankshafts and analyzed to contain 3.75% carbon, 1.38% silicon, 0.35% manganese, and 20 ppm lead. The inoculant within chamber 2 of the mold represents, upon a percentage basis, for a gross weight of 28 Kg of cast metal, 0.5% of PECHINEY inoculant alloy coarsely powdered or 0.075% of introduced magnesium, and 0.1% of powdered Si Ca. These two ingredients were mixed and bagged prior to being placed at the bottom of the treatment chamber and the substance within the cavity 10 of the disk 9 was an inoculant comprising 5% Barium, 2.8% Calcium, and 1.4% Aluminum, and corresponded to 0.15% of the weight of the crankshaft. The temperature of the molten metal within the pouring ladle was 1470°C.

During casting, no signs of the reaction occurring internally of the mold was manifest exteriorly thereof except for a slight release of magnesium oxide, MgO. The time required to fill chamber 2 was 0.18 minutes, and the time for penetration of the blocking plate 8, having a thickness of 0.6 mm, was 0.28 minutes aafter commencement of the casting process.

Upon removal from the mold, it was found that the deadhead had a weight of 14.5 Kg, was full of cavities, and contained all of the slag. The separation of the casting and the deadhead was done easily with a single blow of a sledgehammer.

Figure 3:
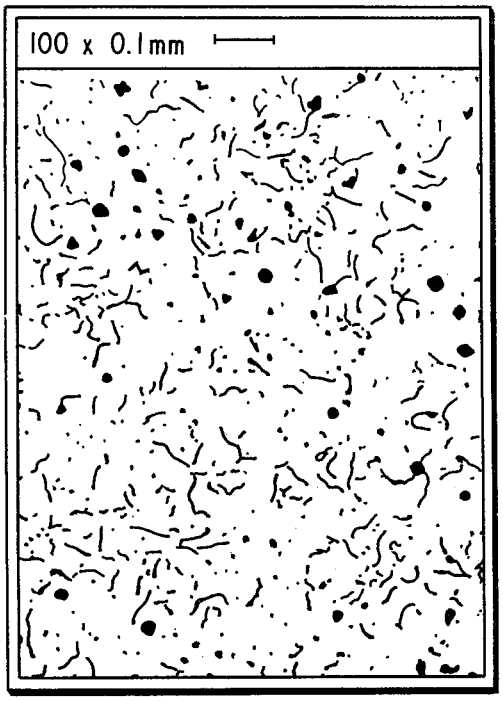
FIG. 3 is a reproduction of a micrograph of a graphitization test sample produced during an initial test of controllling the conditions of casting utilizing the apparatus of the invention.

Micrographic examination of graphitization test samples from the counterweights of the crankshaft revealed a proportion of 90–100% spheroidal graphite over three-quaters or 75% of the length of the part, and a preportion, illustrated by FIG. 3 which is a reproduction of one of the micrographs, of 10–90% spheroidal graphite within the last quarter or 25% of the casting upon the inlet side of the mold. It appears then that within this trial or experiment, the contents of inoculant is below the lower limit.

EXAMPLE 2

The metal used was a cast iron of a type for crankshafts analyzed to contain 3.79% Carbon, 1.45% Silicon, 0.35% Manganese, and 20 ppm Lead. The inoculant within chamber 2 represents upon a percentage basis, for a weight of 29 Kg of metal cast, 0.69% of PECHINEY inoculant alloy coarsely powdered or 0.105% introduced Magnesium and 0.1% powdered SiCa. These two ingredients were mixed and bagged prior to being placed at the bottom of the treatment chamber, and the substance within cavity 10 of disk 9 was an inoculant comprising 5% Barium, 2.8% Calcium, and 1.4% Aluminum and corresponded to 0.15% of the weight of the crankshaft. The temperature of the molten metal within the pouring ladle was 1450°C.

During casting, no sign of the internal reaction within the mold was noted exteriorly of the mold. The time for filling chamber 2 was 0.17 minutes, and the time for penetration of the blocking plate 8, having a thickness of 0.8 mm, was 0.66 minutes after commencement of the casting operation.

Upon removal from the mold, it was found that the deadhead of 15.5 Kg was full of cavities and contained all of the slag. The separation of the casting and the deadhead was easily accomplished by means of a single blow with a sledge-hammer.

Figure 4:
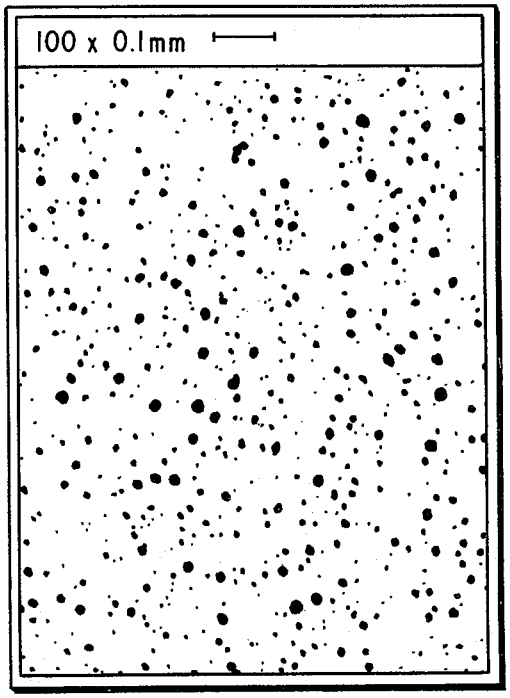
FIG. 4 is the reproduction of a micrograph of a graphitization test sample after establishing control of the conditions of casting.

Micrographic examination of graphitization test samples from the different counterweights of the crankshaft revealed a proportion, illustrated by the micrograph reproduced in FIG. 4, of 100% spheroidal graphite over the entire length of the part, with a large quantity of small and medium sized spheroids.

After simple adjustments are made, as desired, the apparatus of the present invention can be placed into reliable operation. In particular, the conditions of casting are seen to be independent of the human factor, in particular the speed of pouring and filling of the mold, and for this reason, such process lends itself quite satisfactorily to automation.

Obviously, many modifications anad variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. Apparatus for casting iron parts requiring spheroidal graphite texture comprising:

a mold having a pouring channel and containing an impression of the part to be cast;

a treatment chamber disposed within the pouring channel of said mold and containing an inoculant required for the casting of said part, the volume of the portion of said treatment chamber leading to said impression of said part being equal to the sum of the volumes of said part being cast and the deadhead of said part;

said chamber being closed upon the side thereof facing said casting by means of a plug capable of being destroyed by means of the combined action of the temperature and pressure of the molten metal, said plug having a thickness and composition selected to provide a length of time said plug will resist the temperature and pressure of the molten metal charge so as to enable said volume of the portion of said treatment chamber leading to said impression of said part to be filled with said charge before said plug is destroyed; and a separator disc, of neutral refractory material and including a cavity containing an active substance, disposed downstream of said plug;

whereby said inoculation occurs within said chamber during the time necessary for the destruction of said plug.

2. Apparatus for casting as set forth in claim 1, wherein said chamber has associated therewith a runner and said mold has associated therewith a gate, a trap being interposed between said gate and said runner for preventing the formation of oxides upon the metal within said chamber.

3. Apparatus for casting as set forth in claim 1, wherein said active substance contained within said cavity of said separator disk is a post-inoculant deoxidizer.

* * * * *